US006655929B2

(12) United States Patent
Hsieh

(10) Patent No.: US 6,655,929 B2
(45) Date of Patent: Dec. 2, 2003

(54) COOLING FAN DUST GUARD

(75) Inventor: Hsin Mao Hsieh, Taipei (TW)

(73) Assignee: ADDA Corporation, Ping-Tung (TW)

( * ) Notice: Subject to any disclaimer, the term of this patent is extended or adjusted under 35 U.S.C. 154(b) by 0 days.

(21) Appl. No.: 09/972,711

(22) Filed: Oct. 9, 2001

(65) Prior Publication Data

US 2003/0068240 A1 Apr. 10, 2003

(51) Int. Cl.[7] ..... F04B 17/00; F04B 35/00; F04B 39/02; F04B 39/06

(52) U.S. Cl. ..... 417/368; 417/423.9; 417/423.12; 415/176; 416/175; 416/203

(58) Field of Search ..... 417/423.9, 423.12, 417/368; 415/176; 416/175, 203

(56) References Cited

U.S. PATENT DOCUMENTS 2,790,596 A * 4/1957 Stirling ..... 417/362
3,143,283 A * 8/1964 Downs ..... 415/77
5,755,557 A * 5/1998 Alizadeh ..... 416/193 R
5,800,123 A * 9/1998 Travor ..... 415/85
6,270,325 B1 * 8/2001 Hsieh ..... 417/423.12
6,309,178 B1 * 10/2001 Kim et al. ..... 415/176
6,332,758 B1 * 12/2001 Tang et al. ..... 417/354
2002/0122724 A1 * 9/2002 Tseng ..... 416/175
2002/0141871 A1 * 10/2002 Medamaranahally ..... 416/193

* cited by examiner

*Primary Examiner*—Cheryl J. Tyler
*Assistant Examiner*—William H. Rodriguez
(74) *Attorney, Agent, or Firm*—Leong C. Lei

(57) ABSTRACT

A cooling fan dust guard has provided on the inner side of fan blades multiples of fins at equal distance from one another around the spindle to create disturbance as the fan blades rotate to outwardly expel the airflow so to prevent the airflow carrying dust an easy ingression of the dust into the spindle and help cool down the stator assembly.

1 Claim, 5 Drawing Sheets

COOLING FAN DUST GUARD

BACKGROUND OF THE INVENTION (a) Field of the Invention

The present invention is related to a cooling fan dust guard, and more particularly, to one that prevents to prevent the airflow carrying dust an easy ingression of the dust into the spindle and further help improve cooling effect by the stator assembly.

(b) Description of the Prior Art

A cooling fan is usually adapted to a motor. Though providing simple function, the cooling fan plays a very important role in cooling for the entire system. Upon the machine is started, the cooling fan is required to maintain long term operation. Since the cooling fan is essentially working on the spindle and the bearing that are two relatively mobile parts in the system, extra care is required for the interface between said two parts, which must be kept properly lubricated and without ingression of foreign matters to warrant longer service life for the cooling fan, and further for product assurance.

As illustrated in FIG. 1, a cooling fan of the prior art is essentially comprised of a fan blade unit (a) integrated with a stator coil unit (b), a circuit board (c) and a frame (d). Wherein, a spindle (a1) from the center of the fan blade unit (a) passes through a bearing (b1) at the center of the stator coil (b) to constitute a cooling fan as illustrated in FIG. 2. When the cooling fan rotates, the spindle (a1) engages in motion relatively to that of the bearing (b1). However, under long-term dynamic operation, the cooling fan is vulnerable to permit ingression the airflow carrying dust to fall on the gap between the spindle (a1) and the bearing (b1) to damage lubricity of the spindle (1*a*), then the spindle (1*a*) becomes slower, creates higher level of noise, and in serious case, and rendered inoperative due to jammed axis of the blade.

SUMMARY OF THE INVENTION

The primary purpose of the present invention is to provide a cooling fan dust structure (III) that provides on the inner side of fan blades multiples of fins at equal distance from one another around the spindle to create disturbance as the fan blades rotate to outwardly expel the airflow so to prevent the airflow carrying dust an easy ingression of the dust into the spindle and further help improve cooling effect by the stator assembly.

The foregoing object and summary provide only a brief introduction to the present invention. To filly appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
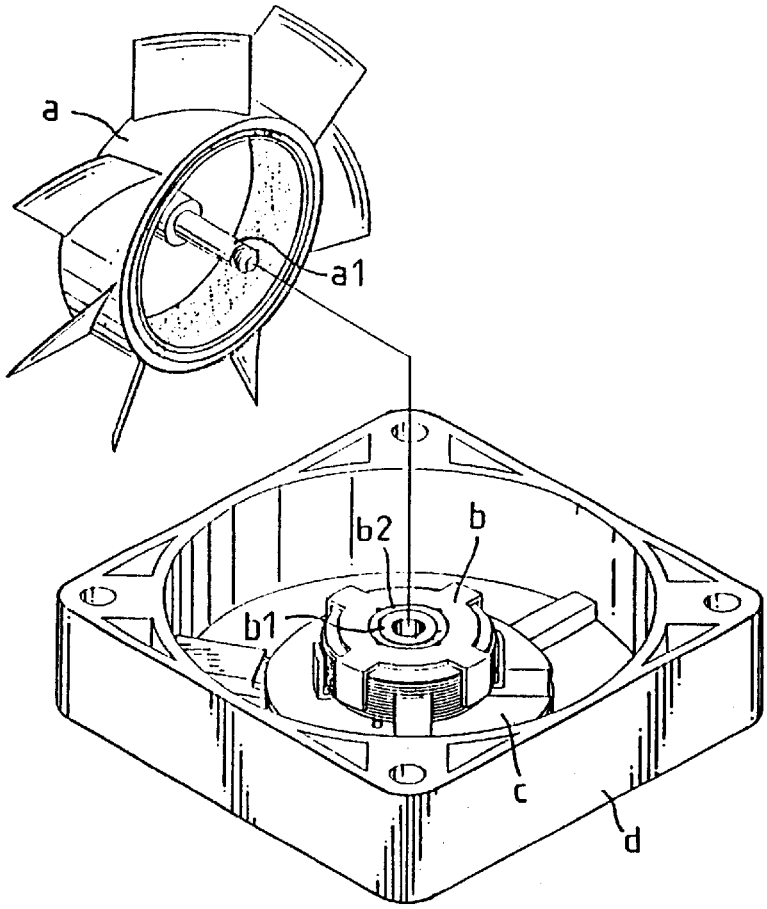
PRIOR ART FIG. 1
FIG. 1 is a view of a structure of a cooling fan of the prior art.
Figure 2:
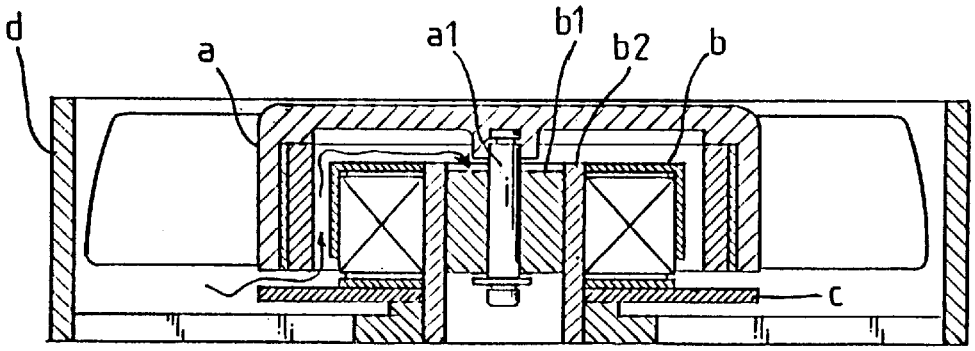
PRIOR ART FIG. 2
FIG. 2 is a sectional view of the cooling fan of the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 3:
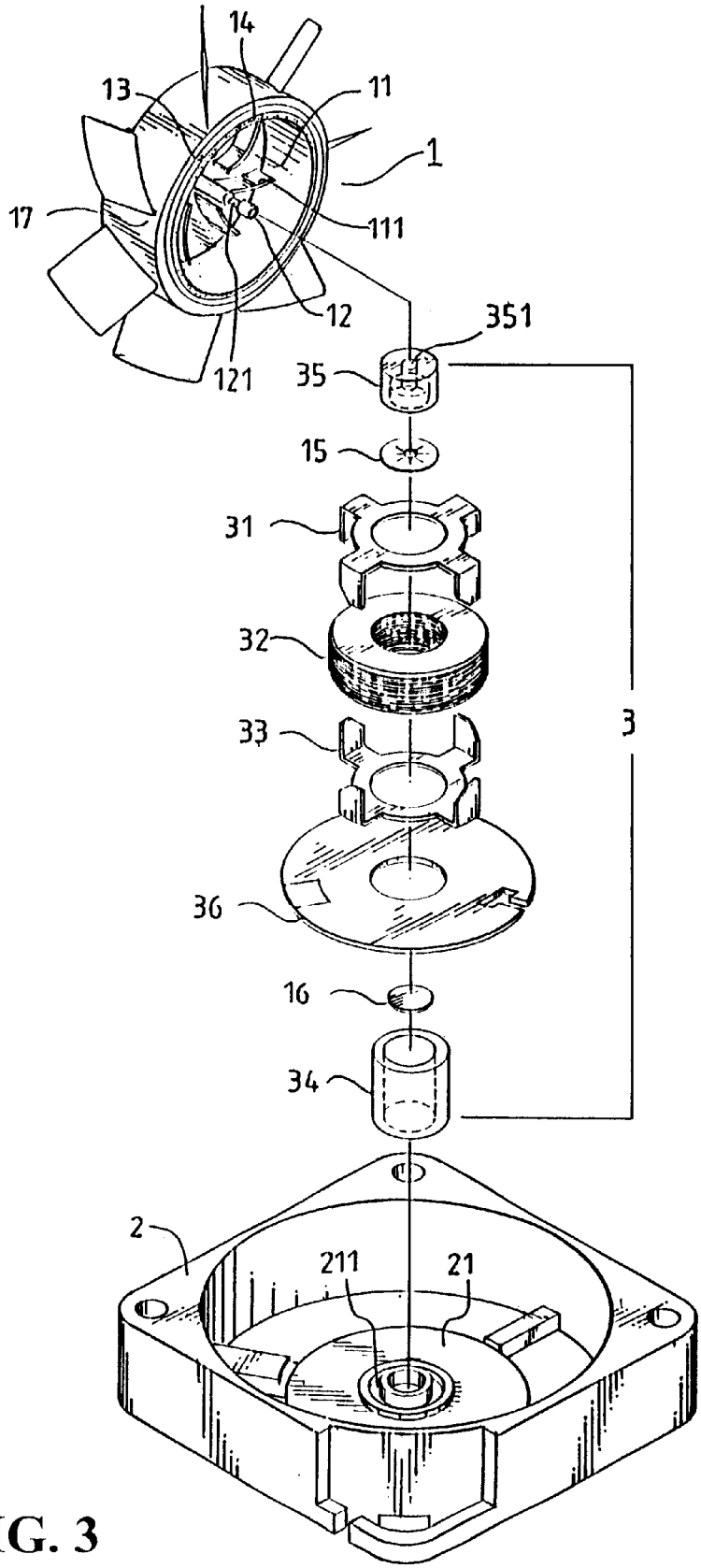
FIG. 3 is an exploded view of a structure of a cooling fan of a preferred embodiment of the present invention.

Referring to FIG. 3, a cooling fan dust structure of the present invention is essentially comprised of a fan blade unit (1), a frame (2), and a stator assembly (3), within, a circular motor base (21) being provided at the center of the frame (2), a fixation base (211) formed by two flanges concentrically arranged in the motor base (21) in different diameters being provided for the stator assembly (3) to fix the stator assembly (3) in position, a friction buffer (16) being provided at the center in the fixation base (211) for the stator assembly (3), a bearing bushing (34) in the stator assembly (3), a bearing (35) in the bearing bushing (34), and a through hole (351) being formed on the end surface of the bearing (35) to allow insertion of a latching bit (15) through a spindle (12) of the fan blade unit (1) to engage a collar (121) of the spindle (12).

Figure 4:
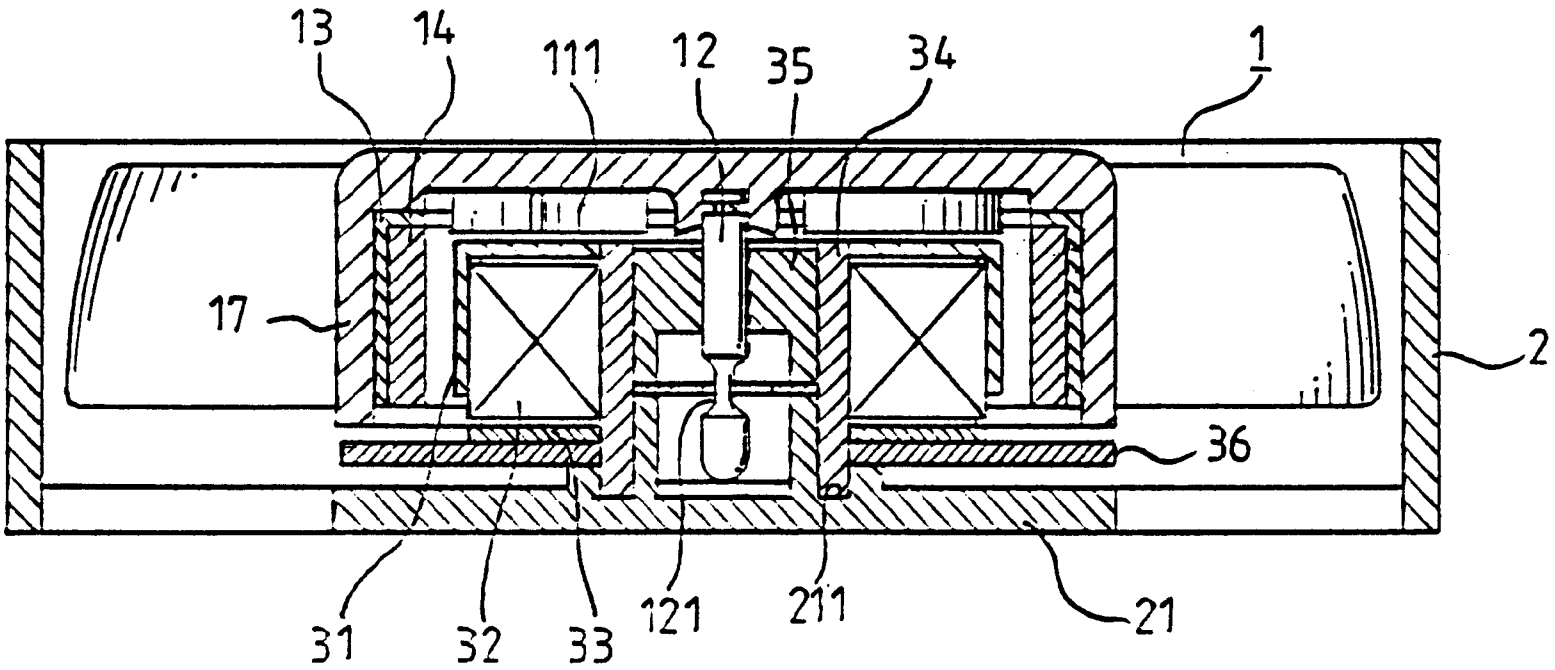
FIG. 4 is a sectional view of the preferred embodiment of the present invention.
Figure 5:
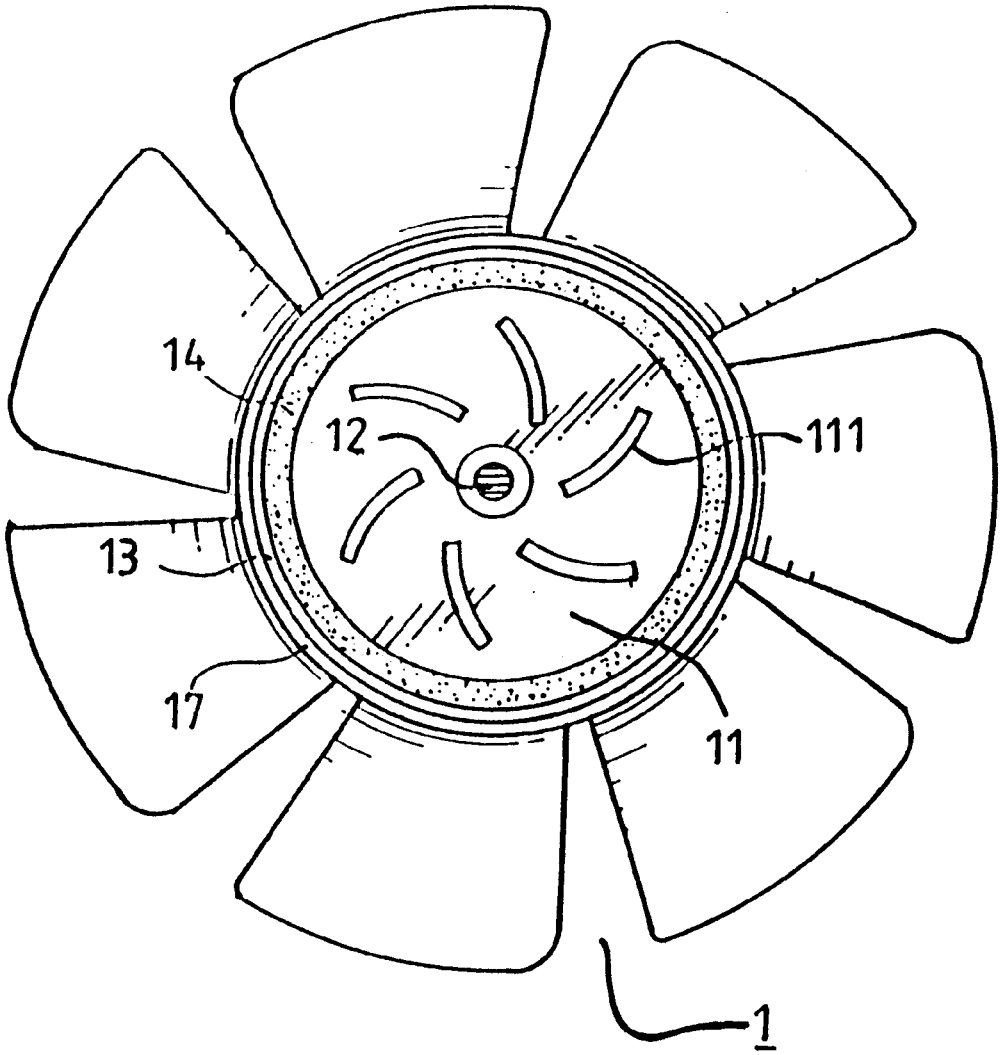
FIG. 5 is a view showing that each of the fins of the preferred embodiment of the present invention is in the form of a crescent.
Figure 6:
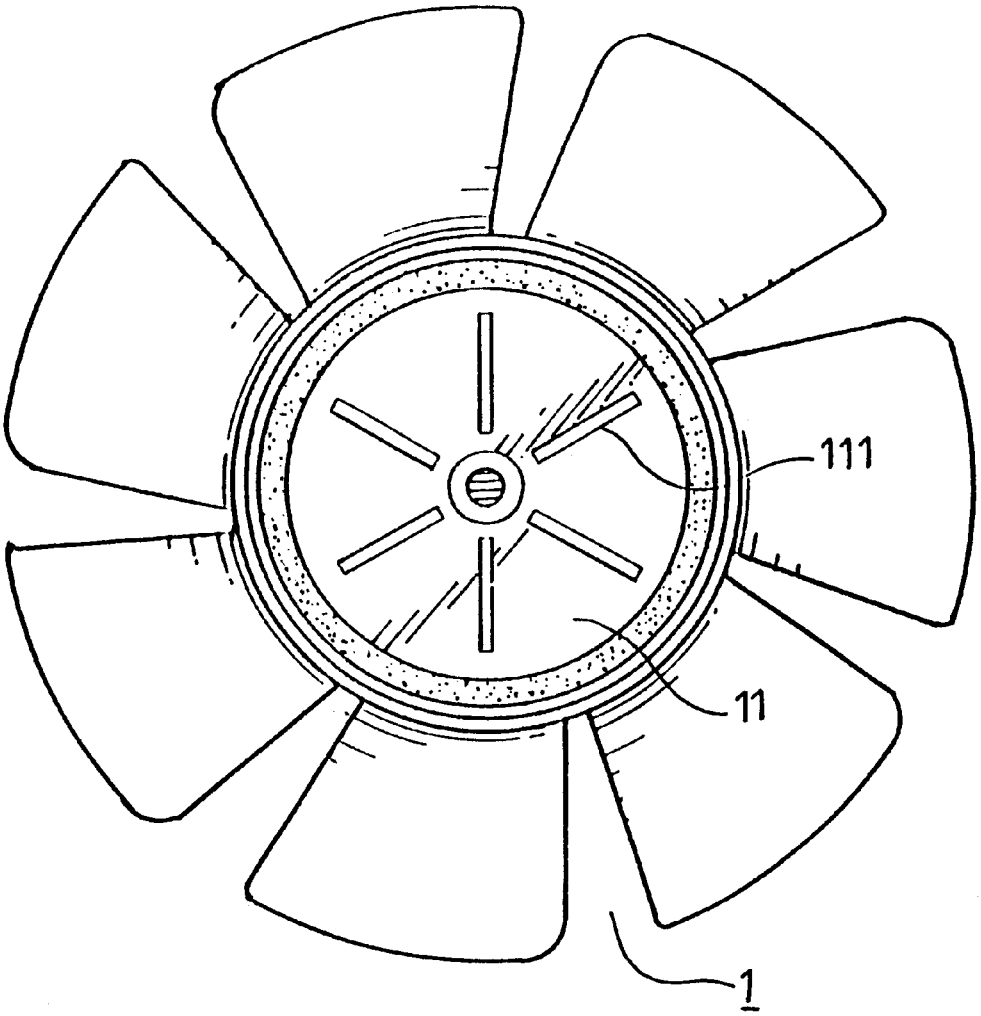
FIG. 6 is a view showing that each of the fins of the preferred embodiment of the present invention is in linear form.

The fan blade unit (1) when driven creates airflow and the spindle (12) extends from the center of the inner surface of the fan blade unit (1). A motor casing (13) and a permanent magnet (14) are provided on the inner edge of the fan blade unit (1). As illustrated in FIGS. 4, 5 and 6, multiples of fins (111) around the spindle (12) at equal spacing from one another protrude from the inner surface (11) of the fan blade unit (1) and each of those fins (111) may be made in linear or crescent form arranged in radius from the spindle (12) at a certain inclination.

When assembled, the bearing (35) connected to the spindle (12) is placed in the bearing bushing (34) at the center of the stator assembly (3) so that the end of the spindle (12) merely holds against the friction buffer (16) in the fixation base (211) for the stator assembly (3) for the bearing bushing (34) and the bearing (35) to define a space of storage of lubrication to the spindle and multiples of latching bits. Once the fan blade unit (1) starts to rotate, the air is disturbed inside a hood (17) of the fan blade unit (1) by those fins (111) to outwardly expel the airflow so as to prevent an easy ingress of the airflow carrying dust into the spindle (12), thus to achieve the dust-proof purpose. Furthermore, it helps cool down the stator assembly (3).

The present invention for providing those multiples of fin around the spindle and arranged at equal spacing from one another to create disturbance to the airflow during the rotation of the fan blade unit thus to effectively stop ingression of flying dust to fall on the spindle to damage the lubricity of the free end of the spindle; easy production from clearly defined and compact members, complies with industrial requirements. Therefore, this application is duly filed accordingly.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cooling fan dust structure comprising: a blade unit, a frame, a stator assembly, a circular motor base provided at a center of said frame, a fixation base formed by two flanges concentrically arranged in said motor base in different diameters provided for said stator assembly to fix said stator assembly in position, a friction buffer provided at a center of said fixation base for said stator assembly, a bearing bushing in said stator assembly, a bearing in said bearing bushing, and a through hole formed on an end surface of said bearing to allow insertion of a latching bit through a spindle of said fan blade unit to engage a collar of said spindle, said fan blade unit creating airflow when driven, said spindle extending from a center of an inner surface of said fan blade unit, a motor casing and a permanent magnet being provided on an inner edge of said fan blade unit, a plurality of fins around said spindle at equal spacing from one another protruding from an inner surface of said fan blade unit and each of said fins being made in linear or crescent form and arranged in radius from said spindle at an inclination, whereby when assembled, said bearing connected to said spindle is placed at said bearing bushing at a center of said stator assembly so that an end of said spindle holds against said friction buffer in said fixation base for said stator assembly for said bearing bushing and said bearing to define a space of storage of lubrication to said spindle and said latching bit, and once said fan blade unit starts to rotate, air is disturbed inside a hood of said fan blade unit by said fins to outwardly expel airflow so as to prevent an easy ingress of said airflow carrying dust into said spindle thus achieving dust-proof and helping cool down said stator assembly.

* * * * *